US010926120B2

(12) United States Patent
Schnell et al.

(10) Patent No.: US 10,926,120 B2
(45) Date of Patent: Feb. 23, 2021

(54) SPRINKLER HOUSING FOR A SPRINKLER, SPRINKLER FOR FIRE EXTINGUISHING SYSTEMS, AND USE THEREOF

(71) Applicant: MINIMAX GMBH & CO. KG, Bad Oldesloe (DE)

(72) Inventors: Stefan Schnell, Stockelsdorf (DE); Frank Rönnfeldt, Travenbrück (DE)

(73) Assignee: Minimax GmbH & Co. KG, Bad Oldesloe (DE)

( * ) Notice: Subject to any disclaimer, the term of this patent is extended or adjusted under 35 U.S.C. 154(b) by 0 days.

(21) Appl. No.: 15/765,452

(22) PCT Filed: Oct. 4, 2016

(86) PCT No.: PCT/EP2016/073682

§ 371 (c)(1),
(2) Date: Apr. 2, 2018

(87) PCT Pub. No.: WO2017/060246

PCT Pub. Date: Apr. 13, 2017

(65) Prior Publication Data

US 2018/0296868 A1 Oct. 18, 2018

(30) Foreign Application Priority Data

Oct. 5, 2015 (DE) ..... 10 2015 219 191.5

(51) Int. Cl.
*A62C 37/14* (2006.01)

(52) U.S. Cl.
CPC ..... *A62C 37/14* (2013.01)

(58) Field of Classification Search
CPC ..... A62C 37/14
(Continued)

(56) References Cited

U.S. PATENT DOCUMENTS 4,007,878 A * 2/1977 Anderson ..... A62C 37/10 239/209
4,217,961 A * 8/1980 Wotton ..... A62C 37/10 169/41

(Continued)

FOREIGN PATENT DOCUMENTS

CN 1148347 A 4/1997
CN 2322653 Y 6/1999

(Continued)

OTHER PUBLICATIONS

International Searching Authority, International Search Report in German & English translation in International Appln. No. PCT/EP2016/073682, dated Nov. 11, 2016, 11 pages.

(Continued)

*Primary Examiner* — Chee-Chong Lee
(74) *Attorney, Agent, or Firm* — Perkins Coie LLP

(57) ABSTRACT

The invention relates to a sprinkler housing (50) for a sprinkler (1), in particular for operating pressures above 16 bar, comprising a fluid channel (12) which is provided in the sprinkler housing (50) and has a fluid inlet (10) and at least one fluid outlet (8), a closure element (4), which is movable from a blocking position into a release position in a release direction (A), wherein the closure element (4) closes the fluid channel (12) in the blocking position and releases same in the release position, a sealing element (5), which is mounted on the closure element (4) and is designed to close the fluid channel (12) in a fluid-tight manner in the blocking position, wherein a protective chamber in which the sealing element (5) is arranged is defined between the closure element (4) and the recess (17) in the release position.

20 Claims, 7 Drawing Sheets

(58) Field of Classification Search
USPC ..... 239/569
See application file for complete search history.

(56) References Cited

U.S. PATENT DOCUMENTS

| | | | | |
|---|---|---|---|---|
| 4,619,327 | A * | 10/1986 | Pieczykolan | A62C 37/14 169/38 |
| 5,622,225 | A | 4/1997 | Sundholm | |
| 6,296,062 | B1 | 10/2001 | Sundholm | |
| 6,962,208 | B2 | 11/2005 | Franson et al. | |
| 7,510,128 | B2 * | 3/2009 | Schouten | B05B 12/0022 239/541 |
| 2006/0237199 | A1 | 10/2006 | Sundholm | |
| 2014/0367125 | A1 | 12/2014 | Krager | |
| 2014/0374126 | A1 | 12/2014 | Helasuo | |

FOREIGN PATENT DOCUMENTS

| | | | |
|---|---|---|---|
| CN | 1730163 | A | 2/2006 |
| CN | 201370915 | Y | 12/2009 |
| DE | 198 12 994 | A1 | 9/1999 |
| DE | 200 02 324 | U1 | 5/2000 |
| DE | 299 22 674 | U1 | 8/2000 |
| DE | 10 2008 060233 | A1 | 6/2009 |
| EP | 0797465 | A1 | 10/1997 |
| EP | 0797466 | A1 | 10/1997 |
| EP | 1404418 | A1 | 4/2004 |
| EP | 1944066 | A2 | 7/2008 |
| JP | H10-500045 | A | 1/1998 |
| JP | 2008-264039 | A | 11/2008 |
| WO | WO 95/31254 | A1 | 11/1995 |

OTHER PUBLICATIONS

First Office Action and English translation, Chinese Application No. 2016800069157.7, 20 pages (dated Feb. 10, 2020).
Office Action (with English translation), Japanese Application No. 2018-536342, 6 pages. (dated Oct. 6, 2020).

* cited by examiner

SPRINKLER HOUSING FOR A SPRINKLER, SPRINKLER FOR FIRE EXTINGUISHING SYSTEMS, AND USE THEREOF

PRIORITY CLAIM AND INCORPORATION BY REFERENCE

This application is a 35 U.S.C. § 371 application of International Application No. PCT/EP2016/073682, filed Oct. 4, 2016, which claims the benefit of German Application No. 10 2015 219 191.5, filed Oct. 5, 2015, each of which is incorporated by reference in its entirety.

TECHNICAL FIELD

The present invention relates to a sprinkler housing for a sprinkler, in particular for operating pressures above 16 bar, according to the precharacterizing clause of claim 1. The invention also relates to a sprinkler having such a sprinkler housing and to the use of such a sprinkler housing.

BACKGROUND AND SUMMARY OF THE INVENTION

Sprinkler housings referred to at the beginning are known in general. A recurring problem in the case of such sprinkler housings is the longevity of the sealing elements used in the sprinkler housings. As a matter of principle, the sealing elements are frequently fastened to the closure element, or to a stationary seat lying opposite the closure element and together with which the closure element closes the fluid duct in the blocking position.

If the closure element is opened, extinguishing fluid flows at very great magnitude occur within the sprinkler housing in particular at the high pressures mentioned above. Said extinguishing flows also take hold of the sealing element in the case of the known housings and lead to the sealing element being heavily subjected to a shearing and abrasion stress. This may lead, indeed, in particular in the case of sealing elements which have aged over long lifetimes, to partial or complete destruction of the sealing element. The detached parts of the sealing elements are picked up by the flow and move freely in the interior of the sprinkler housing. In extreme cases, it may be the case here that the parts of the sealing elements are deposited on or in the fluid outlets of the sprinkler housing and thus lead to a partial or, in the worst case scenario, complete blockage.

Accordingly, the invention was based on the object of specifying a sprinkler housing, in which the abovementioned disadvantages are overcome as substantially as possible. In particular, the invention was based on the object of specifying a sprinkler housing, in which the risk of an obstruction of the fluid outlet(s) is reduced.

The invention achieves the object on which it is based with a sprinkler of the type referred to at the beginning having the features of claim 1. Advantageous developments emerge from the dependent claims and the description and the figures.

The invention proposes in particular a sprinkler housing, for a sprinkler for high operating pressures in which a fluid channel is provided in the sprinkler housing with a fluid inlet and at least one fluid outlet, a closure element, which is movable from a blocking position into a release position in a release direction A, wherein the closure element closes the fluid channel in the blocking position and releases same in the release position, a sealing element, which is mounted on the closure element and is designed to close the fluid channel in a fluid-tight manner in the blocking position, wherein the sprinkler housing has a recess, through which the closure element extends at least in the release position, wherein a protective chamber in which the sealing element is arranged is defined between the closure element and the recess in the release position. The invention is based on the finding that the most effective protection measure for the sealing element consists in removing it as far away as possible from the main flow, which extends from the fluid inlet to the fluid outlet or the fluid outlets in the triggering event, i.e. when the closure element is in the release position. For this purpose, according to the invention a protective chamber is provided between the recess for receiving the closure element and the sealing element, within which protective chamber the sealing element is arranged. In other words, according to the invention, in the release position, the sealing element is located within the recess in order to receive the closure element in a region with reduced flow. The admission into said recess means that the sealing element is exposed to less severe stresses due to the flow of the extinguishing fluid, and the risk of partial or complete destruction of the sealing element is greatly reduced.

In a particularly preferred refinement of the invention, the sprinkler housing has a distribution chamber from which both the recess for receiving the closure element and the at least one fluid outlet branch, wherein the recess for receiving the closure element extends in a first direction, preferably identically to the release direction A, and the at least one fluid outlet extends in a second direction which is different from the first direction. Owing to the fact that the recess branches off from the distribution chamber, the sealing element, in the release position of the closure element, is de facto located outside the distribution chamber in a "secondary arm" which is already exposed to a less severe flow on account of the fact that the main flow takes place in the direction of the fluid outlets. In addition, in the recess and around the recess, on account of the differently oriented axes of the fluid outlet and of the recess for receiving the closure element, turbulence is formed around the recess for receiving the closure element, the turbulence further reducing the flow loading on the sealing element.

The at least one fluid outlet preferably lies arranged radially outside and/or, as seen in the release direction A, upstream of the recess for receiving the closure element. In particular because of the "preference" for the fluid outlets counter to the release direction, a dead space in which flow moves primarily turbulently is formed below the fluid outlets during operation.

In a further preferred refinement, the closure element has an encircling groove in which the sealing element sits. The encircling groove provides a depression for receiving the sealing element, said depression receiving the sealing element into the closure element partially or completely radially, as a result of which further shielding of the sealing element from the surrounding fluid flow is provided.

Counter to the release direction A and adjacent to the encircling groove accommodating the sealing element, the closure element preferably has a projection for protecting the sealing element against flow influences in the release position. The projection forms the flank of the groove, in which the sealing element sits, which flank is positioned out of the groove in the direction of the distribution chamber. The provision of such a projection has the effect that the protective chamber which is formed between the recess for receiving the closure element and the closure element itself is at least partially closed on its side positioned counter to the release direction A and preferably facing the distribution chamber. This creates a particularly strong partitioning of the sealing element from the flow conditions prevailing in the distribution chamber. This structural solution is appropriate for particularly high operating pressures, for example in the region above 100 bar.

In a further preferred embodiment, a flow diverter is formed on the projection. The flow diverter is preferably designed to serve as an impact element for the extinguishing fluid entering the distribution chamber and to produce turbulence.

The flow diverter preferably extends into the distribution chamber counter to the release direction A. Furthermore preferably, the flow diverter is designed to divert extinguishing fluid, which flows into the distribution chamber, from the first direction in which the recess is oriented.

Furthermore preferably, the flow diverter is designed to divert extinguishing fluid, which flows into the distribution chamber, toward the second direction in which the fluid outlet or the fluid outlets are oriented.

The projection preferably has a diameter of at least the sum of a basic diameter of the groove, which accommodates the sealing element, and half of the material thickness in the radial direction of the sealing element. This ensures good protection and at the same time a reliable fit of the sealing element in the groove.

The sprinkler housing is advantageously developed by the fact that the at least one fluid outlet is designed as a bore, or alternatively as a reversibly releasably coupled insertion element which, in particularly preferred refinements, has a swirl body.

By means of the design as an insertion element, diverse fluid output patterns, for example spray cones, can be realized.

In a further preferred refinement, the sprinkler housing according to the present invention has a cage which defines a cage compartment for receiving the closure element in the release position, and for receiving a thermally activatable triggering element in the blocking position. This refinement in particular permits the use of the sprinkler housing as an open extinguishing nozzle if the use of the thermally activatable triggering element is dispensed with. In this case, in the mounted installation position of the sprinkler housing, the closure element is permanently in the release position, which is not disadvantageous because the sealing element is arranged in the protective chamber.

Alternatively, this refinement permits the use of the sprinkler housing together with a thermally activatable triggering element, which is inserted into the cage compartment, in a sprinkler, in particular in a high-pressure sprinkler. Consequently, the invention also achieves the object on which it is based in a sprinkler of the type referred to at the beginning by a sprinkler housing designed according to one of the preferred embodiments described above being used thereon.

Furthermore, the invention achieves the object on which it is based by the use of a sprinkler housing according to one of the preferred embodiments described above as an extinguishing nozzle, in particular as an extinguishing nozzle for operating pressures in the region above 16 bar.

BRIEF DESCRIPTION OF THE DRAWINGS

The invention is described in more detail below with reference to the attached figures using a preferred exemplary embodiment, in which.

MODE(S) FOR CARRYING OUT THE INVENTION

Figure 1:
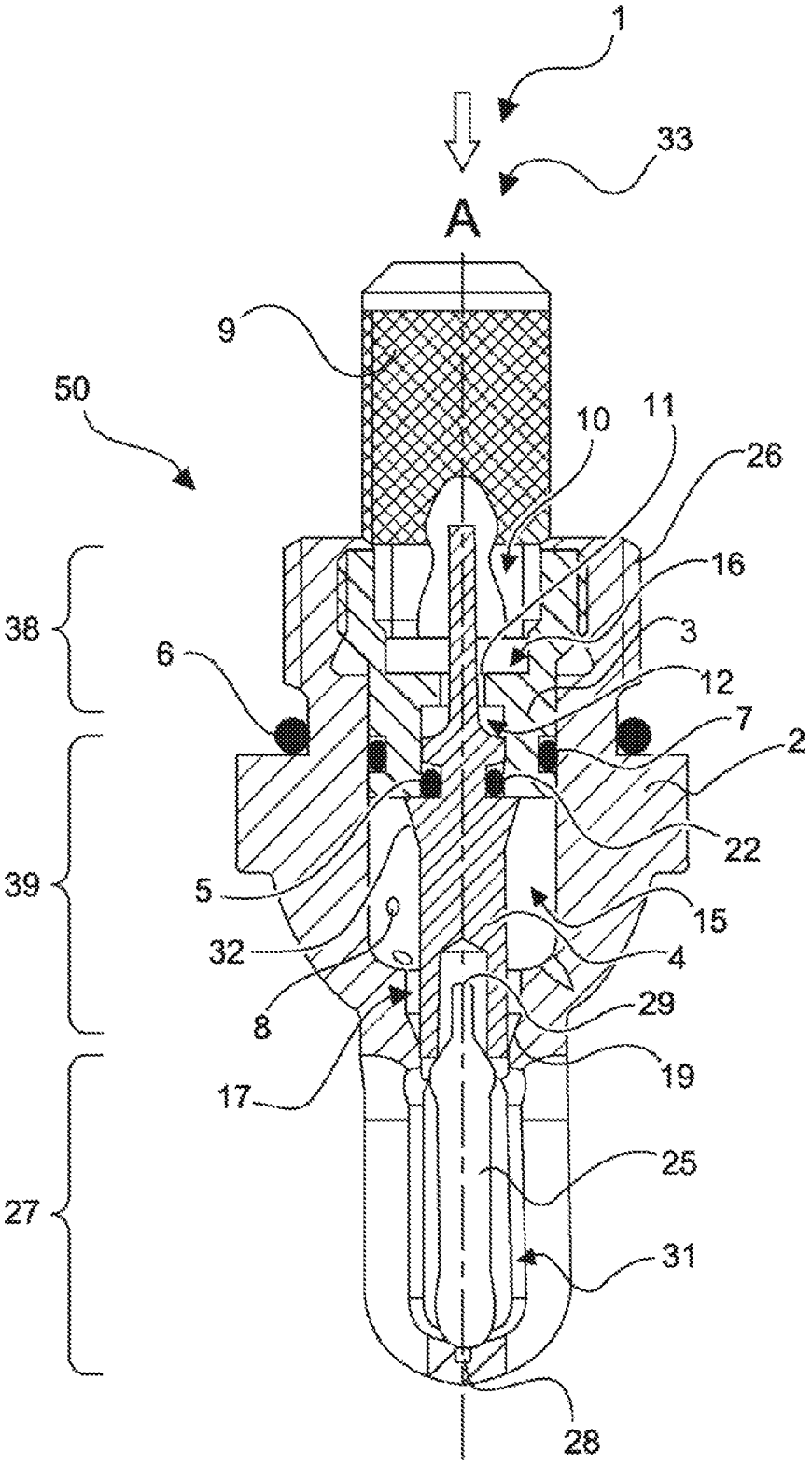
FIG. 1 shows a schematic illustration of a sprinkler in a first operating state.

FIG. 1 shows a sprinkler 1 according to a preferred exemplary embodiment. The sprinkler 1 has a sprinkler housing 50. The sprinkler housing 50 comprises a main body 2, a passage unit 3 and a fluid channel 12, which extends from a fluid inlet 10 to a plurality of fluid outlets 8. A closure element 4 is arranged in a linearly movable manner in the interior of the sprinkler housing 50. In FIG. 1, the closure element 4 is shown in a blocking position in which a sealing element 5 which is compressed radially and axially between the closure element 4 and the passage unit 3 closes the fluid channel 12 and thus prevents the fluid-conducting connection between the fluid inlet 10 and the fluid outlets 8.

A diaphragm 11 for restricting the flow speed is preferably formed in the passage unit 3.

The closure element 4 is kept in the blocking position shown in FIG. 1 by a thermally activatable triggering element 25. The thermally activatable triggering element 25 is held in a cage 27 which is integrally formed on the sprinkler housing 50, in particular on the main body 2. For this purpose, the cage 27 has a first abutment 28 for the axial, and preferably radial, positioning of the thermally activatable triggering element 25, while the closure element 4, at its end facing the thermally activatable triggering element 25, preferably has a second abutment 29 for the axial and/or radial positioning of the thermally activatable triggering element 25. The thermally activatable triggering element 25 sits in a cage compartment 31 defined by the cage 27, and is inserted and held there without a screw connection. The stress required for holding the thermally activatable triggering element 25 is determined exclusively by the dimensioning of the closure element 4 and the compressive force, which acts in the release direction A (FIG. 5), of the extinguishing fluid (reference sign 33) lined up in the fluid channel 12 above the sealing element 5.

A receiving channel 16 for receiving a sieve unit 9 on the side of the fluid inlet 10, and a distribution chamber 15 are formed in the sprinkler housing 50. The fluid outlets 8 and a recess 17 for receiving the closure element 4 branch off from the distribution chamber 15.

The sprinkler housing 50 has a connection unit 38 with a coupling mechanism 26, preferably an external thread, wherein the closure unit 38 serves to connect the sprinkler 1 to a pipe system conducting the extinguishing fluid. For the sealing of the connection unit 38, the sprinkler 1 has a sealing element 6. The passage unit 3 is furthermore sealed in relation to the main body 2 by means of a sealing element 7.

The main body 2 has a nozzle head 39 adjacent to the section of the connection unit 38. The distribution chamber 15 with the fluid outlets 8 is formed in the section of the nozzle head 39. Axially adjacent to the section of the nozzle head 39, the cage 27 is integrally formed on the main body 2, and therefore the main body 2 is formed integrally together with the distribution chamber 15 and cage 27.

Figure 2:
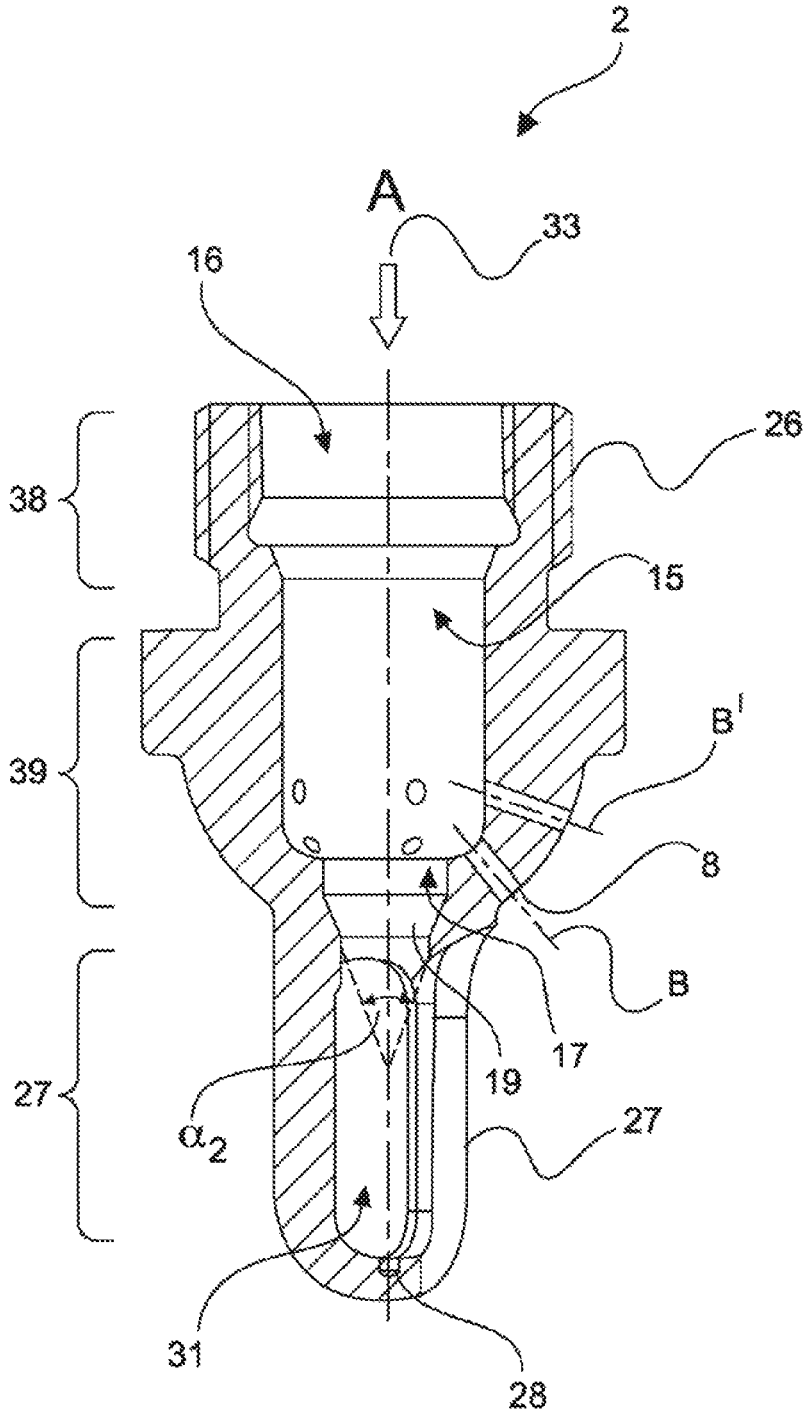
FIG. 2 shows a partial view of the sprinkler according to FIG. 1.
Figure 4:
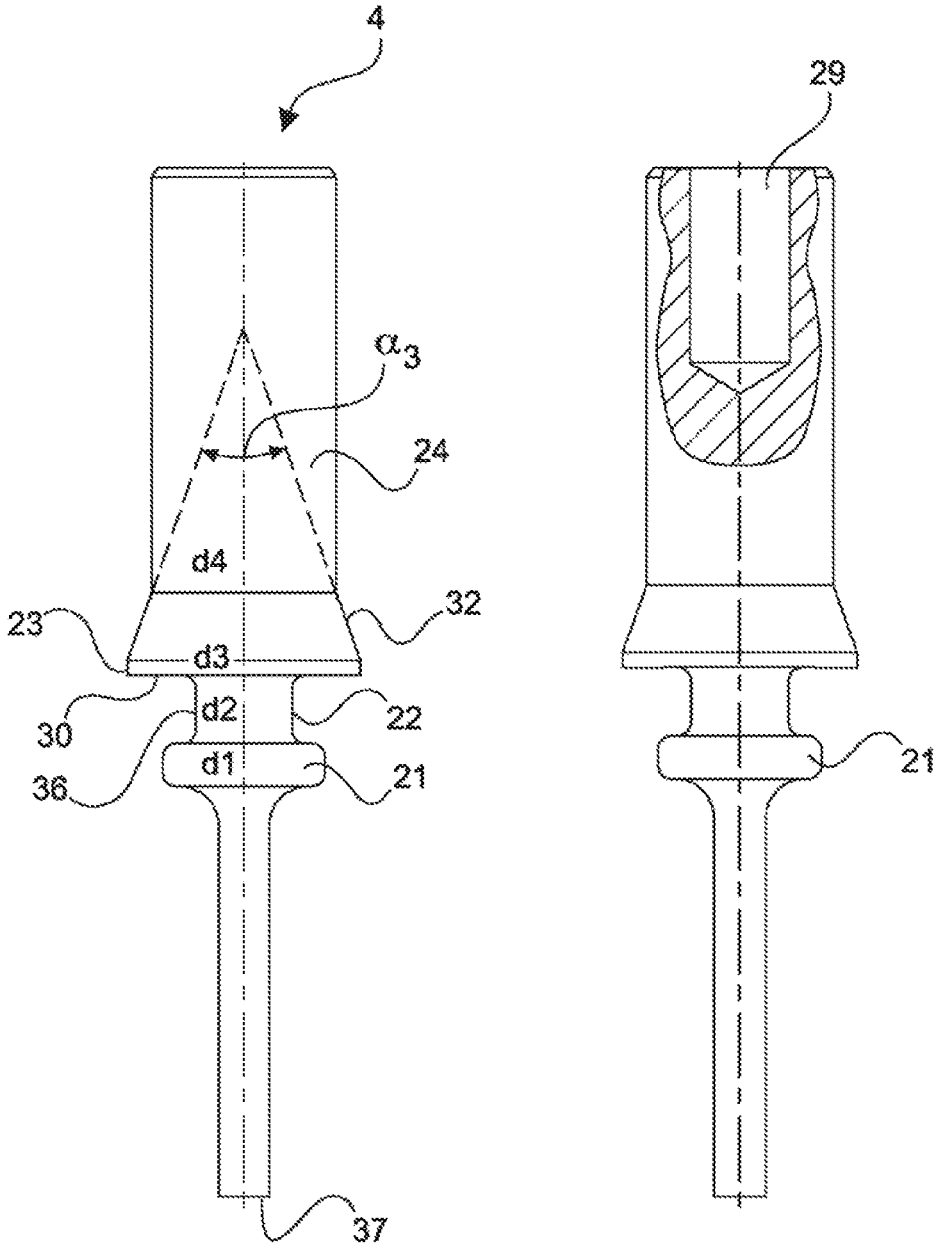
FIG. 4 shows yet another partial view of the sprinkler according to FIG. 1.

As furthermore clearly arises from FIG. 2 in conjunction with FIG. 4, the fluid outlets 8 extend in one or more second direction(s) B, IT, differing from the release direction A, while the recess 17 extends in the release direction A. The extinguishing fluid, indicated by reference sign 33, flowing into the distribution chamber 15 in the release direction A first of all flows in the direction of the recess 17, and has to be diverted from this direction in order to emerge from the fluid outlets. This is discussed in more detail with respect to FIG. 5.

A sealing surface 19 which is tapered in the release direction A is formed at the lower end of the recess 17 in FIG. 2. In the above exemplary embodiment, the tapered sealing surface 19 is of conical design with an angle of taper $\alpha 2$. The closure element 4, illustrated in more detail in FIG. 4, has a sealing surface 32 which, in the mounted state, is likewise tapered in the release direction A and is of conical design in the above exemplary embodiment and has an angle of taper $\alpha 3$. The angles of taper $\alpha 2$ and $\alpha 3$ preferably do not deviate from each other or deviate only slightly, in particular in a region of <5°. The preferably correspondingly designed, tapered sealing surfaces 19, 32 serve as a stop for the closure element in the release position according to FIG. 5. They preferably form an elastomer-free seal 35.

Figure 6A:
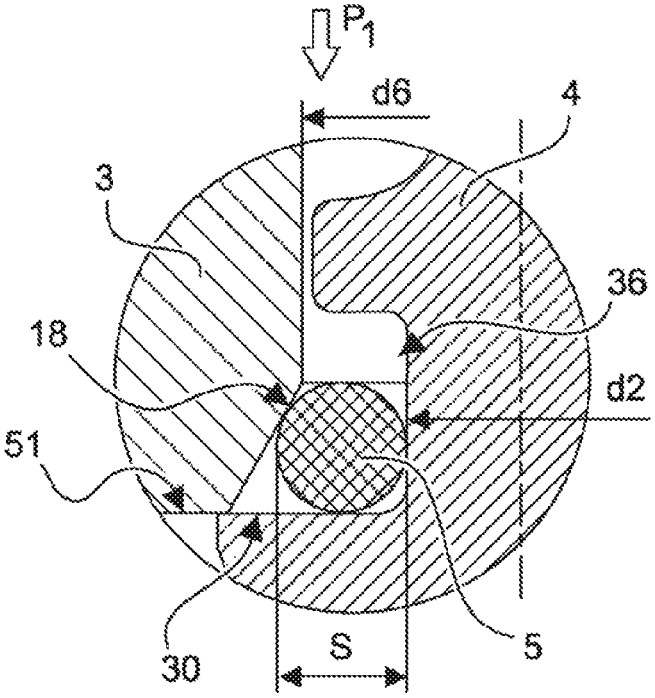

The sealing function of the sealing element 5 will now be explained in more detail with reference in particular to FIGS. 3, 4 and 6*a, b*. A sealing surface 18 which is expanded in the release direction A is formed at the passage unit 3. In the present exemplary embodiment, the expanding sealing surface 18 is of conical design with an angle of taper $\alpha 1$. The diameter of the fluid channel 12 consequently becomes continuously larger in the release direction A over the course of the expanding sealing surface 18. In the blocking position according to FIG. 1, the sealing element 5 lies against the expanding sealing surface 18 and, because of the non-parallel profile of the expanding sealing surface 18 relative to the release direction A, is compressed both radially and axially. This compression behavior is assisted by the fact that, in the blocking position (FIG. 1), the sealing element 5 is pressed against a radially extending sealing surface 30 and an axially extending sealing surface 36. The contact surfaces between the sealing element 5, the passage unit 3 and the closure element 4 therefore form partial sealing surfaces which are each smaller than a single sealing surface would be in the case of a sprinkler known from the prior art with a sealing element.

Figure 6B:
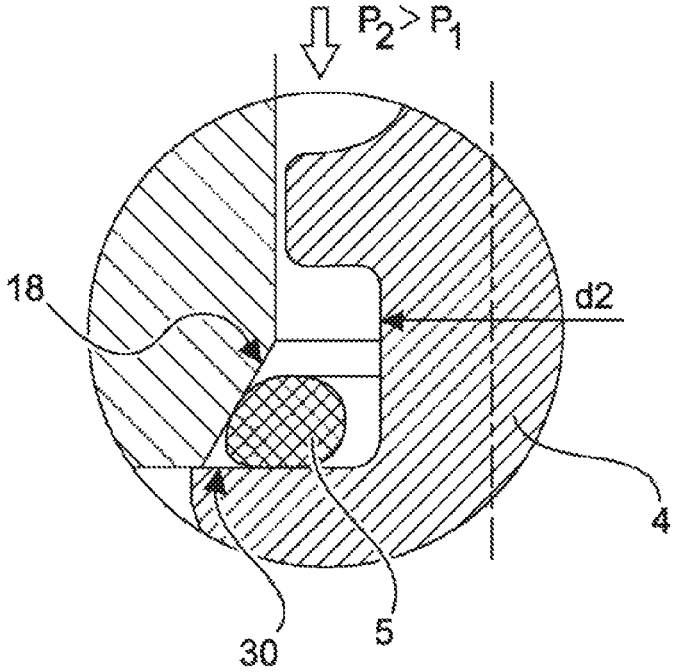

The compression behavior of the sealing element 5 will now be explained in more detail with respect in particular to FIGS. 6*a, b*. In FIG. 6*a*, a first pressure P1 is present on the inlet side of the sprinkler 1. Said pressure is also referred to as a stand-by pressure, and can lie, for example, within a range of 10-13 bar, preferably <12.5 bar. In this installation situation, the sealing element 5 takes on a material thickness S. If the pressure rises to a value P2, shown in FIG. 6*b*, the sealing element 5 is initially still compressed further and is pressed more greatly in the direction of the expanding sealing surface 18 and the radially extending sealing surface 30. The active area of the operating pressure on the closure element is thereby increased. The advantageous configuration of the sealing arrangement in the stand-by mode according to FIG. 6*a* is in particular shown here. When the triggering pressure, which is equal to or greater than the value P2, is exceeded, for example within the range of 40 bar or more, the closure element 4 is moved along out of the blocking position according to FIG. 1 after the thermally activatable triggering element 25 has escaped. The sealing element 5 immediately, merely after a few fractions of a millimeter, loses contact with the expanding sealing surface 18 and releases the fluid flow.

Figure 3:
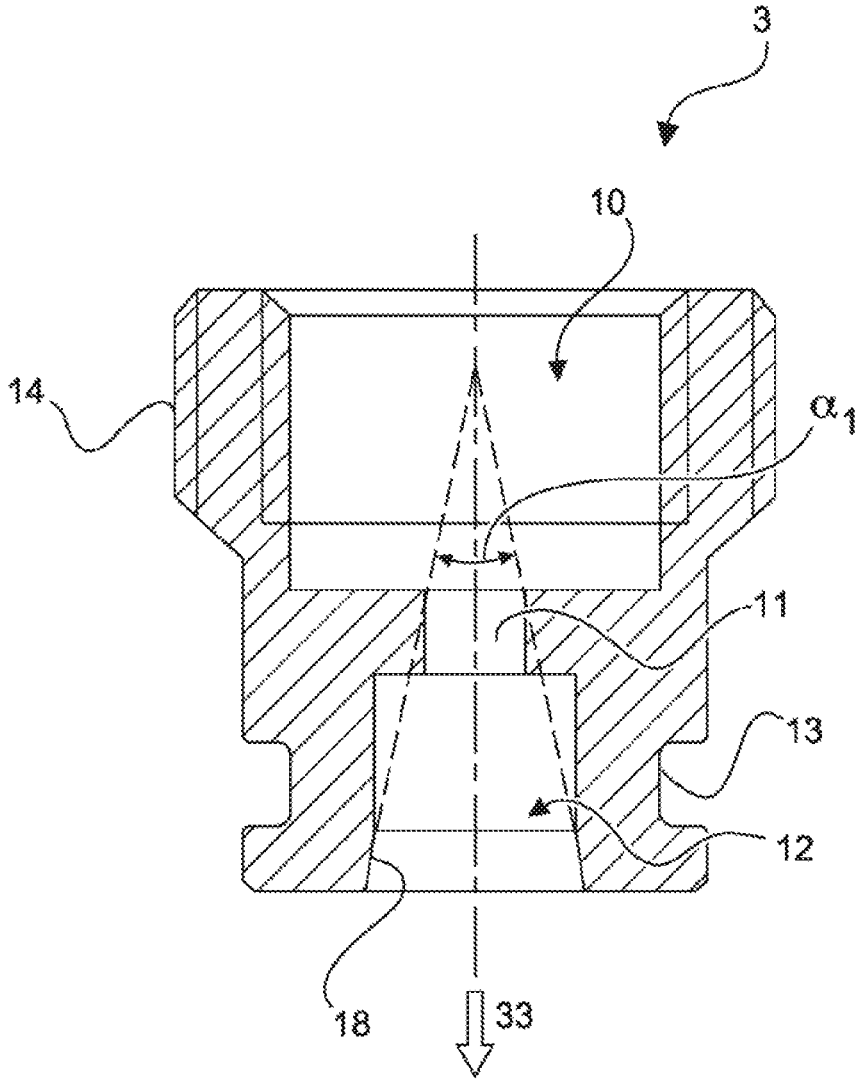
FIG. 3 shows a further partial view of the sprinkler according to FIG. 1.

The passage unit 3 which accommodates the sealing surface 18, which expands in the release direction A, is preferably manufactured as a machined workpiece and, on its outer circumferential surface, has a groove 13 for receiving the sealing element 7 (FIG. 3).

A refinement protecting the sealing element 5 in the release position according to FIG. 5 against wear and destruction will in particular be explained below. For this purpose, reference is made in particular to FIGS. 4 and 5.

Figure 5:
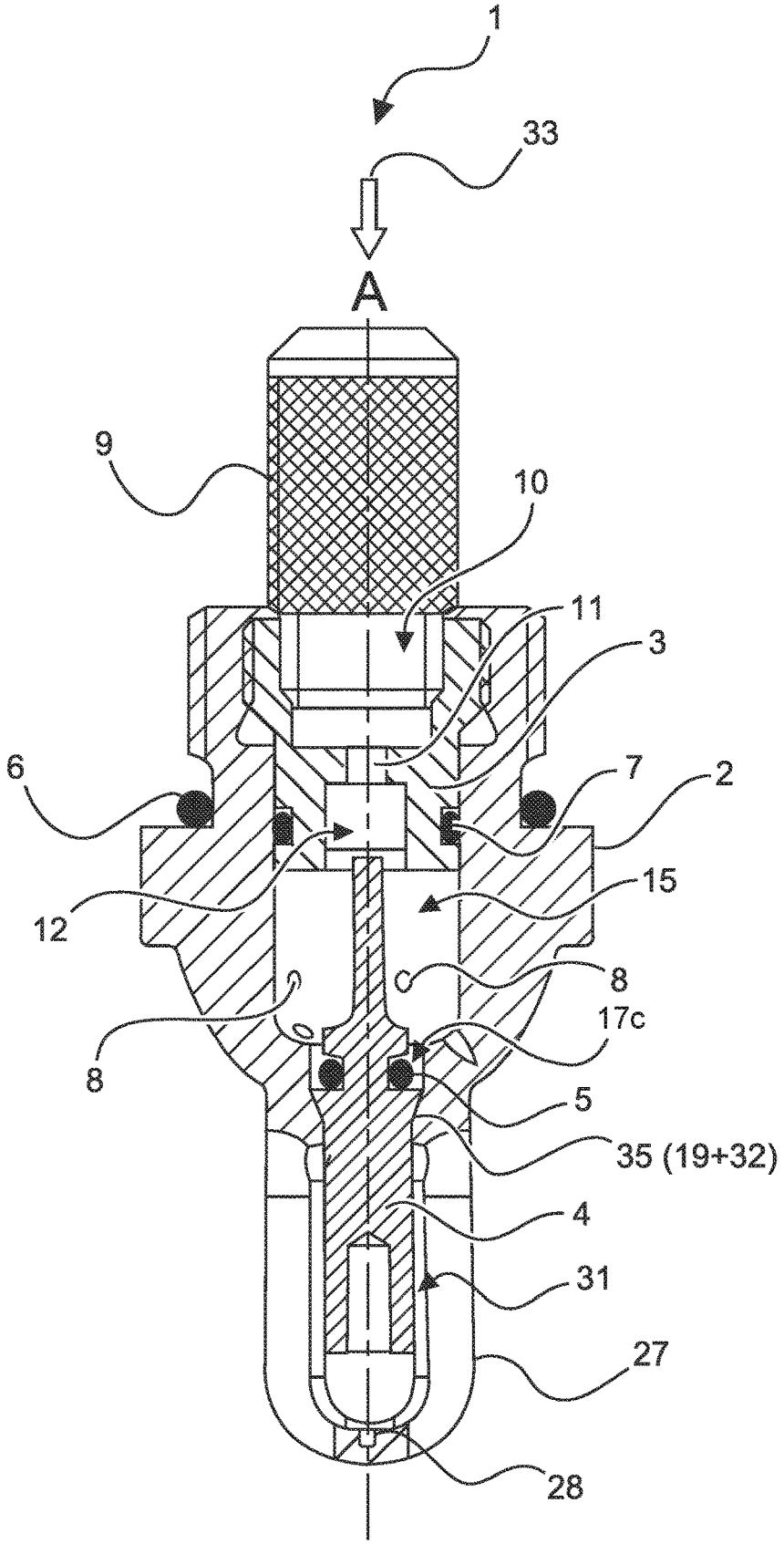
FIG. 5 shows a schematic view of the sprinkler according to FIG. 1 in a second operating state, FIGS. 6*a, b* show a partial view of the sprinkler according to the above figures in the first operating state and in a third operating state.

In the release position of the sprinkler 1 that is shown in FIG. 5, extinguishing fluid 33 presses into the distribution chamber 15 in the release direction A. The closure element 4 is in the release position, shown at the bottom in FIG. 5. At the distribution chamber 17*c*, a protective chamber, in which the sealing element 5 is accommodated, is formed between the closure element 4 and the branching-off recess 17. The protective chamber 17*c* lies on the other side of the main flow direction from the fluid inlet to the fluid outlets 8 because the latter extend in the directions B, B' in a departure from the release direction A (see FIG. 2). By means of this remote arrangement of the sealing element 5, the sealing element 5 is in a region of reduced flow in the release position of the closure element 4 and is less greatly subject to wear due to a rapid flow of the extinguishing fluid. This significantly reduces the susceptibility of the sealing element 5 to being destroyed and reliably prevents blocking of the fluid outlets 8 with sheared-off or torn-off material of the sealing element 5.

The fluid outlets 8 lie radially outside the recesses 17. In the configuration depicted, the closure element 4 has an encircling groove, characterized by the axially extending sealing surface 36 as the groove base. The sealing element 5 is accommodated in said groove. By the sealing element 5 being arranged on the closure element 4 in a manner at least partially retracted into the groove, exposure to the extinguishing fluid flow forced in the direction of the fluid outlets 8 is further reduced. Counter to the release direction A and adjacent to the groove 36, a projection 21 is formed on the closure element and protects the sealing element 5 against flow influences in the release position. A flow diverter 37 which extends counter to the release direction A is particularly preferably formed on the projection 21. In the blocking position shown in FIG. 1, the flow diverter 37 preferably extends for a distance through the diaphragm into the fluid channel 12 in the direction of the fluid inlet 10. In the release position shown in FIG. 5, the flow diverter 37 still extends at least for the most part through the distribution chamber 15 in the direction of the fluid inlet 10. Extinguishing fluid flowing into the distribution chamber 15 is at least retarded by the flow diverter 37, as a result of which the dynamic pressure portion of the extinguishing fluid drops and the loading of the sealing element 5 decreases even further or the sealing element 5 is shielded to an even greater extent. The protected arrangement (shown here) of the sealing element 5 in the protective chamber between recess 17 and closure element 4 makes it possible to use the sprinkler housing 50 as an open extinguishing nozzle without insertion beforehand of a thermally activatable triggering element 25.

Considerable synergy is thereby generated in terms of manufacturing because one and the same component, namely the sprinkler housing 50 together with closure element 4 and sealing element 5, is usable for a plurality of use purposes without having to be refitted. The protected arrangement of the sealing element 5 means that the latter is less likely to be damaged or destroyed, as a result of which inadvertent obstruction of the fluid outlets 8 is even more reliably prevented.

The structure of the closure element will be described in more detail below with reference first of all to FIG. 4.

The closure element 4 is preferably designed as a rotationally symmetrical body having a plurality of sections, in the present example four sections. A first section is the projection 21 with a diameter d1. A second section 22 is present with a diameter d2 and is designed for receiving the sealing element 5. The axial sealing surface 36 and the radial sealing surface 30 are formed in this section. The radial sealing surface 30 is at the same time the transition to a third section 23 with an outer diameter d3 and a section which tapers in the release direction A and has the sealing surface 32. A continuous decrease in diameter in the release direction A to the diameter d4 takes place, wherein a conical profile with the angle of taper α3 is formed. From there, a further section extends with a cylindrical profile in the form of a receiving cylinder 24. The receiving cylinder 24 is designed to penetrate the cage compartment 31 of the cage 27 during movement of the closure element from the blocking position (FIG. 1) into the release position (FIG. 5).

The second abutment 29 is preferably formed in this receiving cylinder 24. The diameters d1, d2, d3 and d4 are preferably in the following size relationship:

D1 is greater than d2, d2 is smaller than d3, and d3 is greater than d4. The second region 22 with the diameter d2 is preferably adapted in its length to the material thickness of the sealing element 5. The difference d3−d2 is preferably greater than the material thickness of the sealing element 5 in the unloaded state. The diameter d3 is preferably greater than the outside diameter of the sealing element 5 in the unloaded state. The radially extending sealing surface 30 dimensioned with diameter d3 therefore serves as a stop surface for the closure element and also serves, when the first sealing element 5 is pressed onto the expanding sealing surface 18, to prevent excessive deformation and shearing off of the sealing element 5, or slipping of the sealing element 5 out of the groove during installation.

Owing to a difference in diameter between d2 and d3, the groove, which is characterized by the axially extending sealing surface 36, in the second region 22 should be understood as an asymmetrical groove.

The diameter d2 preferably lies within a range of 1.5 to 50 mm, particularly preferably within a range of 2 to 12 mm, furthermore particularly preferably within the range of 12 mm to 30 mm.

A view will also be given on the structure of the closure element 4 below with reference to FIGS. 7*a* to 7*f*.

The different variants of the closure element 4 are illustrated in FIGS. 7*a* to 7*f*. The basic structure of the closure element 4 is similar in all of these variants. A substantial exception is the formation of the projection 21 and of the flow diverter 37 thereon. While the exemplary embodiment according to FIGS. 7*a, b* does not have a flow diverter 37, but rather a differentiation is made essentially in respect of the design of the receiving cylinder 24 and the axial extension of the region between the sealing region 22 and the receiving cylinder 24, in which, according to FIG. 7*a*, a cylindrical intermediate section 23*b* and a slightly conically opposed section 23*a* are still formed, the projection 21 of the closure element 4 according to FIG. 7*c* has a flow diverter 37 in the form of an encircling annular projection 37*a* on the end side 40. The projection 37*a* can conversely also be defined as a concave recess 41 in the end side 40.

Figure 7A:
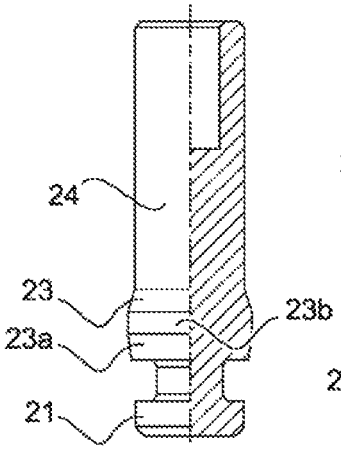
FIGS. 7*a-f* show various alternative designs of a part of the sprinkler according to FIGS. 1 to 6.
Figure 7B:
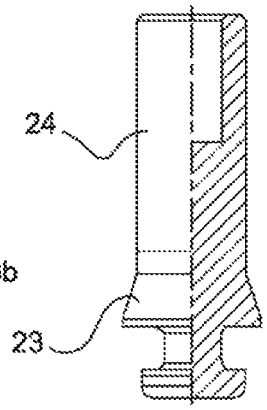
Figure 7C:
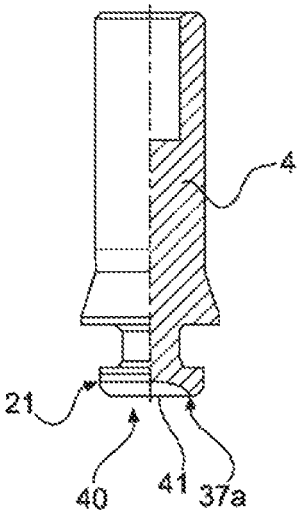
Figure 7D:
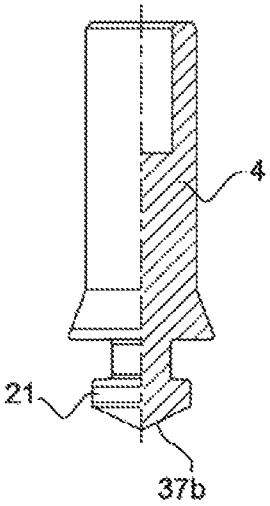

In the case of the closure element 4 according to FIG. 7*d*, a cone point 37*b* is formed on the projection 21, said cone point advantageously assisting the diversion of the extinguishing fluid, which penetrates the distribution chamber 15, radially outward toward the fluid outlets 8.

Figure 7E:
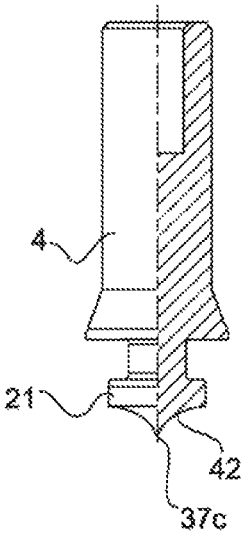
Figure 7F:
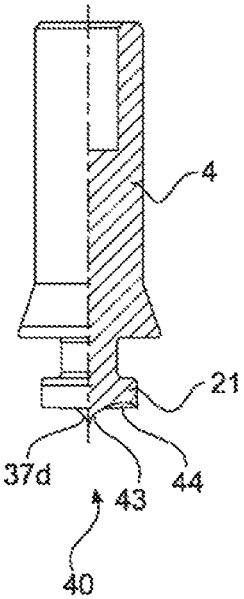

According to FIG. 7*e*, a point 37*c* having a concavely curved lateral surface 42 is formed on the projection 21 of the closure element 4. The concave curvature assists the deflection of the fluid in the direction of the fluid outlets 8 and reduces the impact effect of the fluid striking against the projection 21. FIG. 7*f* shows a variant of the closure element 4, in which a point 37*d* having a concavely curved lateral surface 43 is likewise formed on the projection 21, wherein the concavely curved lateral surface leads into a concave recess 44 on the end side 40, which assists a deflection of the fluid, which strikes against the projection 21, counter to the release direction A.

The advantages of the integral configuration of the main body 2 together with cage 27 and the advantageous effects of preferred combinations of materials will be discussed below.

Owing to the fact that the sprinkler housing 50 has a main body 2 in which both the distribution chamber 15 with the fluid outlets 8, and the cage 27 with the cage compartment 31 are integrally formed, a thermally activatable triggering means 25 can be inserted and then held securely, preferably in the abutments 28, 29, merely by installation of the closure element. An insertion and bracing of the thermally activatable triggering element by means of union nuts and similar means, as are known from the prior art, can be omitted here. Working steps are saved during the installation, and the risk of premature damage to the thermally activatable triggering element by means of too great a stressing force is prevented.

The integral main body 2 is preferably formed from a seawater-resistant copper alloy, for example seawater-resistant brass or one of the other materials mentioned above. However, the seawater-resistant copper alloy is particularly preferred. Furthermore preferably, the main body is chemically nickel plated at least in the region of the fluid outlets, but preferably completely. During the chemical nickel plating, a nickel-phosphorus coating is placed onto the basic material by autocatalytic deposition. Said coating is preferably further hardened by means of a heat treatment. The residence duration and temperature of the heat treatment is preferably adapted here to the melting point of the basic material. If polymers are used as the basic material, the temperature of the heat treatment is naturally lower than in the case of metals, such as, for example, a brass material. The coating created by chemical nickel plating has the particular advantage that, with the aid thereof, the abrasion resistance of materials which are non-curable when taken into isolation, for example brass, can be significantly increased. By this means, the advantages of various materials are favorably linked to one another by sprinkler systems.

The integral combination with the abovementioned choice of materials and heat treatment has the particular advantage that the sprinkler housing 50 as a whole is significantly less susceptible to clogging. Within the course of the approval test of sprinklers and extinguishing nozzles, it has to be ensured that the fluid outlets change only very slightly, if at all, in respect of their pass-through rates over the course of the operation. This relates firstly to a reduction of the outlet cross section by means of obstructions (therefore clogging) but secondly also to the increase in the outlet cross section by means of abrasion. In particular whenever engineering water or seawater is used as the extinguishing fluid, i.e., in simplified terms, water having a particle loading or other impurities, the risk of an increase in the outlet cross sections is generally greater than an obstruction. By means of the increased hardness in conjunction with the corrosion resistance of the basic material and of the coating, the invention provides surprisingly good properties in this regard in an integral main body.

The invention claimed is:

1. A sprinkler housing for a sprinkler having operating pressures above 16 bar, comprising:

a fluid channel which is provided in the sprinkler housing and has a fluid inlet and at least one fluid outlet, a closure element, which is movable from a blocking position into a release position in a release direction, wherein the closure element closes the fluid channel in the blocking position and releases same in the release position, and a sealing element, which is mounted on the closure element and is designed to close the fluid channel in a fluid-tight manner in the blocking position when in a compressed state, wherein the sprinkler housing has a recess through which the closure element extends at least in the release position, the recess having a surface that serves as a stop for the closure element in the release position that locates the sealing element within the sprinkler housing in the release position, wherein a protective chamber is defined between the closure element and the recess in the release position, and wherein the sealing element that is mounted on the closure element and is designed to close the fluid channel in a fluid-tight manner in the blocking position, is disposed in an uncompressed state within the protective chamber between the closure element and the recess, and spaced from the recess, in the release position.

2. The sprinkler housing as claimed in claim 1, wherein the sprinkler housing has a distribution chamber from which both the recess for receiving the closure element and the at least one fluid outlet branch, wherein the recess for receiving the closure element extends in a first direction identically to the release direction, and the at least one fluid outlet extends in a second direction which is different from the first direction.

3. The sprinkler housing as claimed in claim 2, wherein the closure element has an encircling groove in which the sealing element sits.

4. The sprinkler housing as claimed in claim 3, wherein, counter to the release direction and adjacent to the groove, the closure element has a projection for protecting the sealing element against flow influences in the release position.

5. The sprinkler housing as claimed in claim 4, wherein a flow diverter is formed on the projection.

6. The sprinkler housing as claimed in claim 5, wherein the flow diverter extends into the distribution chamber counter to the release direction.

7. The sprinkler housing as claimed in claim 5, wherein the flow diverter diverts extinguishing fluid, which flows into the distribution chamber, from the first direction in which the recess for receiving the closure element is oriented.

8. The sprinkler housing as claimed in claim 5, wherein the flow diverter diverts extinguishing fluid, which flows into the distribution chamber, toward the second direction of the at least one fluid outlet.

9. The sprinkler housing as claimed in claim 4, wherein the projection has a diameter of at least the sum of a basic diameter of the groove and half of the material thickness in the radial direction of the sealing element.

10. The sprinkler housing as claimed in claim 1, wherein the at least one fluid outlet is arranged radially outside and/or upstream of the recess for receiving the closure element.

11. The sprinkler housing as claimed in claim 1, wherein the at least one fluid outlet comprises a bore.

12. The sprinkler housing as claimed in claim 1, further comprising a cage which defines a cage compartment for receiving the closure element in the release position and a thermally activatable triggering element in the blocking position.

13. A high-pressure sprinkler, comprising a sprinkler housing as claimed in claim 12, wherein the thermally activatable triggering element is accommodated in the cage and keeps the closure element in the blocking position until said triggering element is activated.

14. The sprinkler housing as claimed in claim 1, wherein the closure element has an encircling groove in which the sealing element sits, wherein the encircling groove comprises an asymmetrical groove.

15. The sprinkler housing of claim 14, wherein the asymmetrical groove comprises a radial sealing surface and an axial sealing surface.

16. The sprinkler housing of claim 15, wherein, counter to the release direction and adjacent to the asymmetrical groove, the closure element has a projection for protecting the sealing element against flow influences in the release position.

17. The sprinkler housing of claim 14, wherein the surface of the recess that serves as a stop for the closure element in the release position comprises a sealing surface tapered in the release direction.

18. The sprinkler housing of claim 17, wherein the closure element comprises a sealing surface tapered in the release direction.

19. The sprinkler housing of claim 18, wherein the sealing surface tapered in the release direction of the recess has an angle of taper substantially equal to the angle of taper of the sealing surface tapered in the release direction of the closure element.

20. The sprinkler housing of claim 19, wherein, in the release position, the sealing surface tapered in the release direction of the recess and the sealing surface tapered in the release direction of the closure element form an elastomer-free seal.

* * * * *